United States Patent [19]

Walther et al.

[11] 4,295,300

[45] Oct. 20, 1981

[54] FLAP ARRANGED ON DISCHARGE AND SEPARATING DEVICES OF VIBRATORY ABRASIVE CONTAINERS

[75] Inventors: Carl K. Walther, Wuppertal-Vohwinkel; Karl Temme, Wuppertal-Elberfeld, both of Fed. Rep. of Germany

[73] Assignee: Carl Kurt Walther GmbH & Co. KG, Wuppertal, Fed. Rep. of Germany

[21] Appl. No.: 153,807

[22] Filed: May 27, 1980

[30] Foreign Application Priority Data

Jun. 9, 1979 [DE] Fed. Rep. of Germany ..... 2923414

[51] Int. Cl.[3] ..... B24B 31/00

[52] U.S. Cl. ..... 51/163.2

[58] Field of Search ..... 51/163.2, 163.1, 164.1, 51/7

[56] References Cited

U.S. PATENT DOCUMENTS

| | | | |
|---|---|---|---|
| 3,514,907 | 6/1970 | Strom | 51/163.2 |
| 3,633,321 | 1/1972 | Rise | 51/163.2 |
| 4,018,009 | 4/1977 | Leliaert | 51/163.2 |
| 4,042,181 | 8/1977 | Huber | 51/163.1 |
| 4,195,447 | 4/1980 | Walther | 51/163.2 |

FOREIGN PATENT DOCUMENTS

| | | | |
|---|---|---|---|
| 1444893 | 8/1976 | United Kingdom | 51/163.2 |

*Primary Examiner*—H. D. Whitehead

*Attorney, Agent, or Firm*—Martin A. Farber

[57] ABSTRACT

Discharge and separating devices of vibratory abrasive containers forming a trough and having a flap for placing into operation a separating path which is coordinated behind the flap, the flap being swingable around the flap shaft axis which is transverse to the container trough and being able to be moved upwardly by means of an actuating device into a maximum upper position. A control lever is operatively connected to the actuating device being pivotally mounted under a portion of flap parallel to the flap shaft, the control lever having a free end formed with a pin. The flap is formed with an elongated slot having an end region, the pin engaging into the slot in the flap and limiting the upward movement of the flap by abutting against the end region of the slot.

13 Claims, 6 Drawing Figures

FLAP ARRANGED ON DISCHARGE AND SEPARATING DEVICES OF VIBRATORY ABRASIVE CONTAINERS

This invention relates to a flap arranged on discharge and separating devices of vibratory abrasive containers in order to bring into action a separation path which is developed, for instance, in the form of a screen arranged behind the flap, the flap being swingable around an axis which is transverse to the container trough and being adapted to be brought by an actuating device into a raised position which cannot be exceeded, a control lever which is swingable to the actuating device being mounted below the flap parallel to the axis of the flap.

As stop limitation for the flap in its raised position of the upper edge of the container trough is provided with known stops against which the flap rests. The control of the flap is effected in this connection by a lever which acts on the shaft of the flap. This development, however, involves the danger of accidents. In case of inattention it may happen that the operator, for instance, extends his hand into the region between a stop and the top side of the flap, resulting in injuries, particularly if there is remote control of the flap.

The object of the invention is to provide a flap of the type in question which is of a construction easy to manufacture and advantageous to use, of such a nature as to avoid a limiting by stops which might result in accidents.

This object is achieved in the manner that the free end of the control lever engages via a pin into an elongated slot in the flap and limits the upward movement of the flap by coming against the end region of the slot.

As a result of this development, the parts which form the stop limitation are no longer within the region which is accessible to the operator. The device is in itself limited by stops. There is no longer the danger of crushing accidents. The space located below the flap is utilized to contain the control lever which swings the flap. The flap shaft now serves exclusively for the mounting of the flap and the actuating device (which is normally coupled with the shaft of the flap) displaces the control level which, upon its swinging, carries the flap along with it as a result of the pin-slot control and holds the flap in its corresponding position. It has been found that despite the vibrations, the flap remains in the position which has been selected for it. This solution is very resistant to wear.

Figure 1:
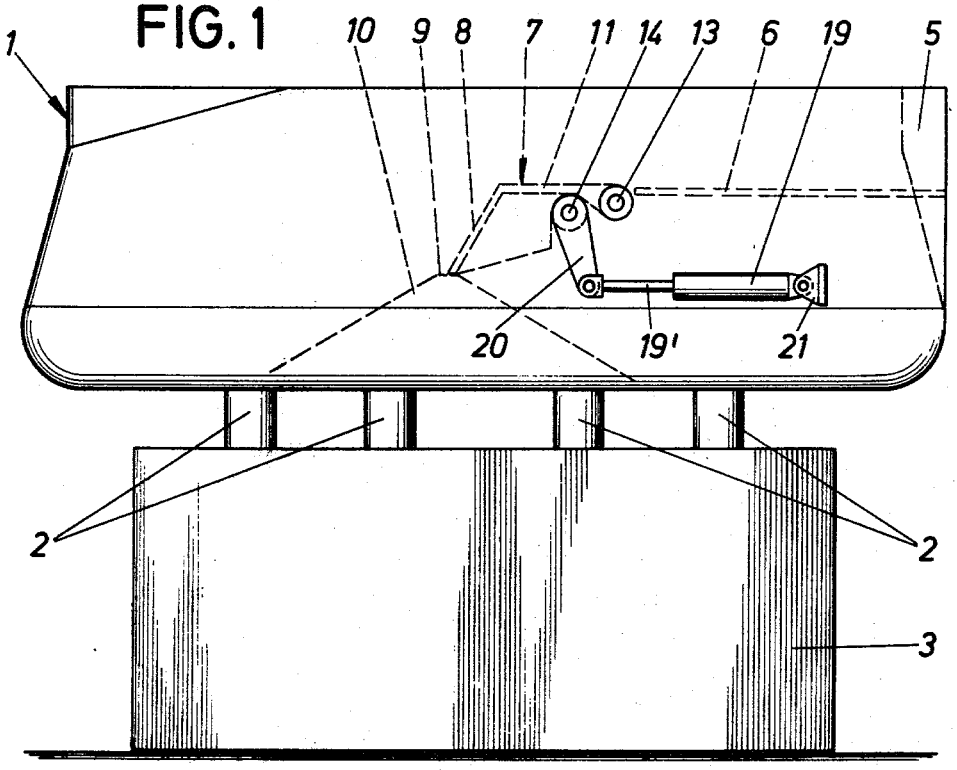
Figure 2:
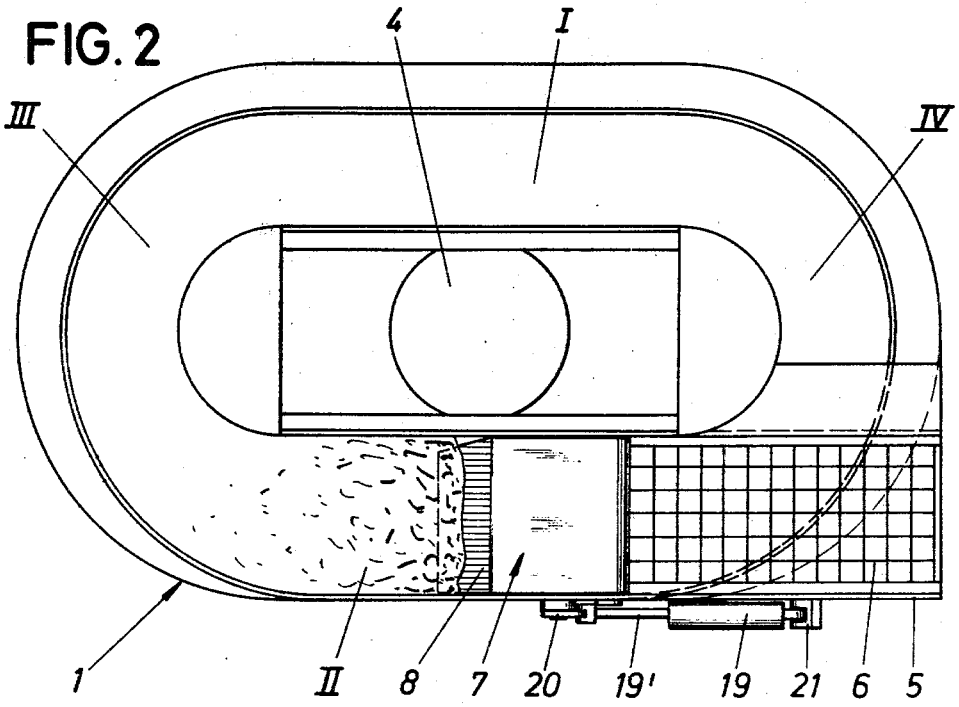
Figure 4:
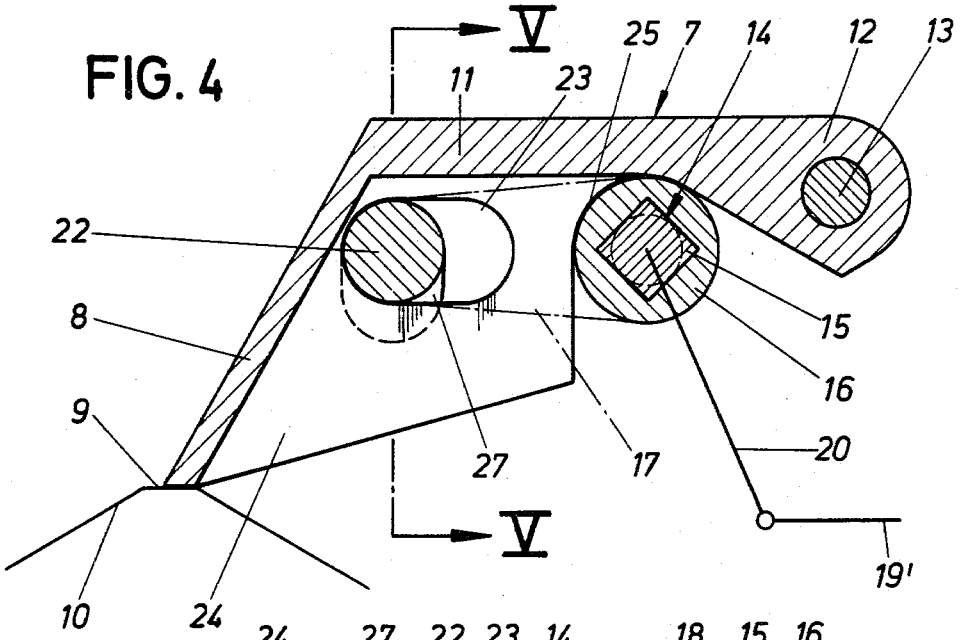
Figure 3:
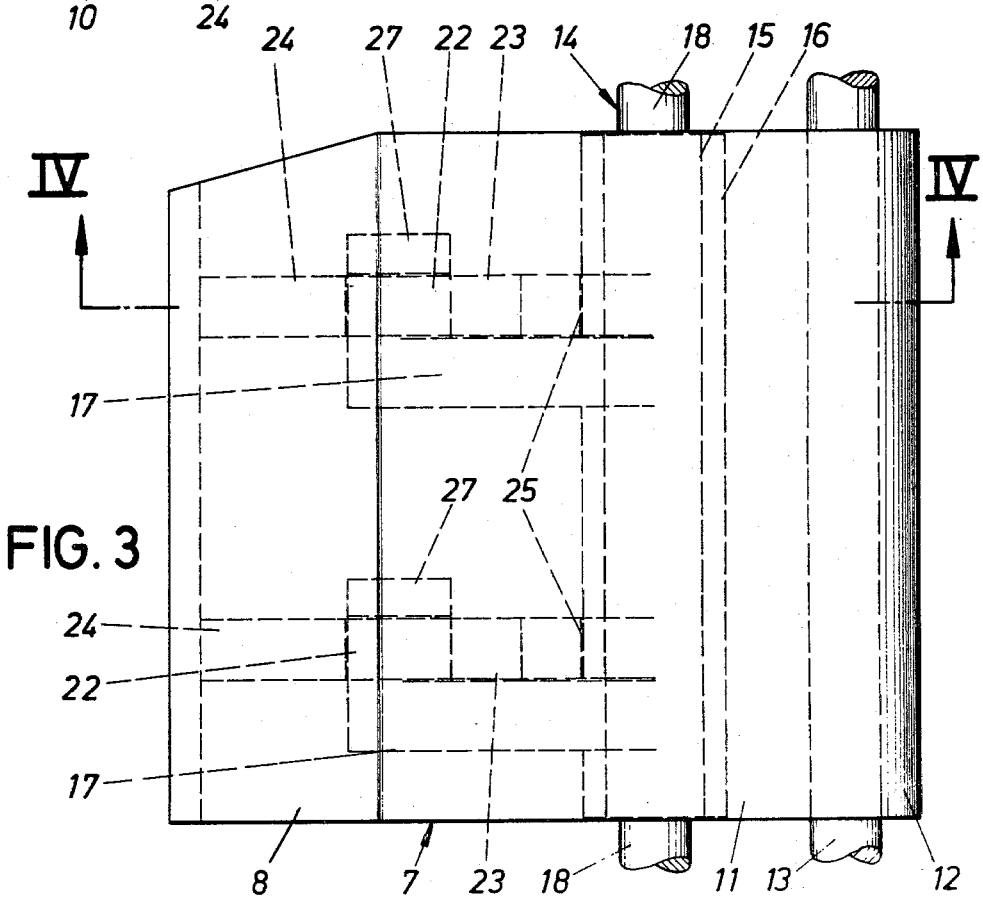
Figure 5:
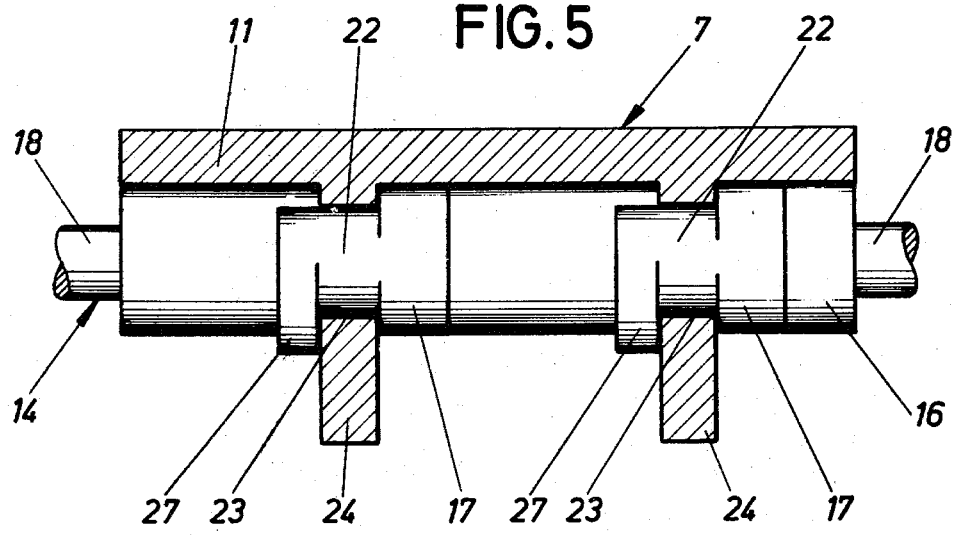
Figure 6:
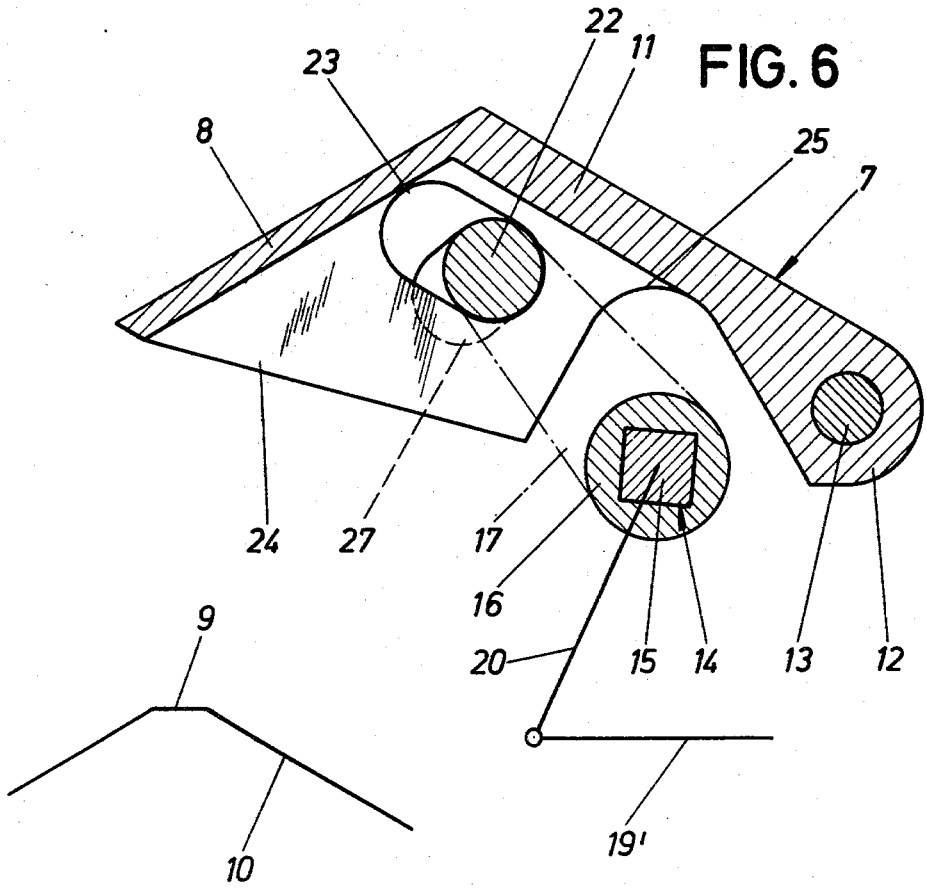

Other advantages of the invention will become evident from the following description of one illustrative embodiment of the invention shown in FIGS. 1 to 6, in which FIG. 1 is a front view of a vibratory scouring container which is supported by a machine frame, shown with its flap in the downward position, FIG. 2 is a top view of FIG. 1, FIG. 3 shows, on a larger scale, a top view of the flap connected with the control lever, FIG. 4 is a section along the line IV—IV of FIG. 3, the flap being in its downward position, FIG. 5 is a cross section along the line V—V of FIG. 4 and FIG. 6 is a view corresponding to FIG. 4 but with the flap in its upper position.

The vibratory abrasive container 1 has a stadium-shaped contour and rests via spring elements 2 on the machine frame 3.

The container trough consists of the linear trough sections I and II as well as the two semi-circular 180° bends III and IV. The vibratory abrasive container is imparted its vibrations by the vibration generator 4 arranged centrally in the vibratory abrasive container 1; see FIG. 2.

The linear trough section II is continued to an outlet spout 5. The discharge and separating device is located in front of the latter. The device has a separating screen 6 a part of which extends over the working trough. Adjoining the separating screen 6 is a flap 7 which is of a roof-shape as seen in longitudinal section and the front surface 8 of which, in the downward position of the flap 7, rests on the vertex 9 of a weir 10 on the bottom of the linear trough section II. This position of the flap is selected when the workpieces are discharged and the working bodies are to fall through the separating screen 6.

Separating screen 6 and other part surfaces 11 of the flap 7 extend approximately at the same height when the flap 7 is in its downward position; see FIG. 1. The rear edge of the flap which faces the separating screen 6 is provided with a thickened portion 12 through which the flap shaft 13 passes. The shaft extends transversely to the container trough and is seated in bearings arranged on the side of the container trough, but not shown in detail.

Below the flap 7 and eccentrically to the flap shaft 13 is a control-lever shaft 14. The section 15 of shaft 14 which extends between the side walls of the container trough is of square cross section and passes in complementary form-locked manner through a hub 16 from which a pair of control levers 17 extends. The control-lever shaft 14 is extended or continues at its ends into journal stubs 18 which rest swingably in bearings on the container trough. On the free end of the journal stub 18 which lies on the outside of the container there is seated rotatable therewith, an actuating lever 20 coupled with a pressure cylinder 19. The pressure cylinder 19 in its turn is supported on a bearing pedestal 21 arranged outside the container.

On the free end of each control lever 17 there is a pin 22 which is aligned parallel to the flap shaft 13 and the control-lever shaft 14 and engages into an elongated slot 23 in the flap 7. The slots 23 are provided in stabilizing ledges 24 of flap 7 which are arranged in pairs. They provide reinforcement in the region of the angle of the flap. As can be noted from FIG. 4, the slot 23 extends in the direction of the flap shaft 13. The stabilizing ledges 24 terminate in a throat 25 which, in the downward position of the flap 7, places itself in form-locked substantially complementary manner onto the control-lever shaft or the hub 16. Furthermore, the bottom of the flap surface 11 is supported in this downward position on the hub 16.

The pin 22 which engages into the slot 23 projects laterally and carries an abutment shoulder 27 which extends only over or beyond a part of the circumference of the pin. Therefore, upon mounting it is necessary first of all to bring the stop shoulder 27 with the pin 22 into alignment with the slot 23. Only then can the parts be inserted one into the other and swung with respect to each other. After mounting, the abutment shoulder 27 extends on one side of the stabilization ledge 24 and the control lever 17 on the other side thereof, obtaining a composite engagement which will not loosen unintentionally.

If the content of the container is to pass through the container trough several times, the pressure cylinder 19 is imparted an impulse. Its piston rod 19' moves forward and, via the actuating lever 20, swings the control-lever shaft 14 into the position shown in FIG. 6. In this way the flap 7 is brought into raised position by means of the pin-slot control 22, 23. In this position the pins 22 and the slots 23 which cooperate with them constitute the parts which provide the stop limitation. Since they are concealed, however, below the flap, the stop limitation does not result in any danger of accidents.

We claim:

1. In discharge and separating devices of vibratory abrasive containers forming a trough and having a flap for the placing into operation a separating path which is coordinated behind the flap, the flap being swingable around an axis of the flap shaft which is transverse to the container trough and being able to be moved upwardly by means of an actuating device into a maximum upper position, the improvement comprising a control lever operatively connected to the actuating device being pivotally mounted under a portion of flap parallel to the flap shaft, the control lever having a free end formed with a pin, the flap being formed with an elongated slot having an end region, the pin engaging into the slot in the flap and constituting means for limiting the upward movement of the flap by abutting against the end region of the slot.

2. The flap according to claim 1, wherein the flap has stabilization ledges arranged on a bottom-side of the flap, the slot is formed in each of the stabilization ledges, a common shaft, a pair of the control levers are seated on the common shaft and cooperate via the pins on each of the free ends of the control levers, respectively, with the slots in each of the stabilization ledges, respectively.

3. The flap according to claim 2, wherein the pins which engage into the elongated slots respectively project laterally on the free end of each of the control levers, respectively, an abutment shoulder is held on each said pin respectively and extends only over a portion of the periphery of the pin.

4. The flap according to claim 1, wherein the elongated slot extends in a direction towards the flap shaft.

5. The flap according to claim 1, further comprising a control lever shaft, the control lever is mounted on the control lever shaft, the flap is supported against the control lever shaft in a downward position of the flap.

6. The flap according to claim 5, wherein the flap includes stabilization ledges, the stabilization ledges form a throat, the throat is seated in form-locked manner on the control lever shaft in the downward position of the flap.

7. The flap according to claim 6 wherein the stabilization ledges are formed on a bottom side of the flap and the slot is formed in each of the stabilization ledges, a pair of the control levers are mounted on the control lever shaft and cooperate via the pins on each of the free ends of the control levers, respectively, with the slots in each of the stabilization ledges, respectively.

8. The flap according to claim 3, wherein the abutment shoulder engages one side of a corresponding of the stabilization ledges and a corresponding of the control levers engages the other side of the corresponding stabilization ledge.

9. The flap according to claim 3, wherein the abutment shoulders project perpendicularly relative to an axis of the pins, respectively.

10. The flap according to claim 3, wherein the abutment shoulders extend offset relative to a longitudinal axis of the control levers, respectively.

11. The flap according to claim 2, wherein the common shaft extends parallel to the flap shaft and constitutes means for the pivotal mounting of the control levers.

12. The flap according to claim 6, wherein the control lever shaft extends parallel to the flap shaft and constitutes means for the pivotal mounting of the control lever.

13. The flap according to claim 6, wherein the flap has an angular formation, and the stabilization ledges are formed at the angular formation as reinforcements thereof.

* * * * *